US010948196B2

(12) United States Patent
Mok et al.

(10) Patent No.: US 10,948,196 B2
(45) Date of Patent: Mar. 16, 2021

(54) COOKING VESSEL SUPPORT SYSTEM HAVING A GAS BURNER AND GAS DELIVERY SYSTEM

(71) Applicants: BSH Home Appliances Corporation, Irvine, CA (US); BSH Hausgeräte GmbH, Munich (DE)

(72) Inventors: Andy Mok, Stanton, CA (US); Brian Silva, Knoxville, TN (US); Tyson White, Anderson, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 54 days.

(21) Appl. No.: 16/421,516

(22) Filed: May 24, 2019

(65) Prior Publication Data

US 2020/0370757 A1 Nov. 26, 2020

(51) Int. Cl.

| | |
|---|---|
| ***F24C 15/10*** | (2006.01) |
| ***F24C 3/08*** | (2006.01) |
| ***F23D 14/04*** | (2006.01) |

(52) U.S. Cl.

CPC ..... *F24C 15/107* (2013.01); *F23D 14/04* (2013.01); *F24C 3/082* (2013.01); *F24C 3/085* (2013.01); *F23D 2900/14042* (2013.01)

(58) Field of Classification Search

CPC .. F24C 3/08; F24C 3/082; F24C 3/085; F24C 15/107; A47J 36/34

See application file for complete search history.

(56) References Cited

U.S. PATENT DOCUMENTS

| | | | | |
|---|---|---|---|---|
| 7,881,593 | B2 * | 2/2011 | Grassi | F24C 15/10 392/480 |
| 9,206,985 | B2 | 12/2015 | Saubert | |
| 9,970,662 | B2 * | 5/2018 | Cadima | F23D 14/84 |
| 10,151,491 | B2 * | 12/2018 | Cadima | F23C 5/02 |
| 10,458,657 | B2 * | 10/2019 | Tisselli | F24C 3/08 |
| 2012/0097148 | A1 | 4/2012 | Schoenemann et al. | |
| 2014/0246009 | A1 * | 9/2014 | Tisselli | F24C 3/08 126/39 E |
| 2018/0142897 | A1 | 5/2018 | Cadima | |

* cited by examiner

*Primary Examiner* — David J Laux

(74) *Attorney, Agent, or Firm* — Michael E. Tschupp; Andre Pallapies; Brandon G. Braun

(57) ABSTRACT

A cooking appliance is provided, including a cooktop floor and a removable cooking vessel support system on the cooktop floor. The cooking vessel support system includes a support frame configured to support a cooking vessel above a gas burner, the support frame having at least a first arm supporting the gas burner above and spaced apart from the cooktop floor. The support frame includes an internal passageway in fluid communication with the gas burner and configured to draw primary air into the support frame at a location above the cooktop floor and to mix the primary air with an injected gas to provide an air-gas mixture. At least a portion of the internal passageway is formed in the first arm of the support frame such that the air-gas mixture is guided by the internal passageway through the first arm to the gas burner.

22 Claims, 9 Drawing Sheets

COOKING VESSEL SUPPORT SYSTEM HAVING A GAS BURNER AND GAS DELIVERY SYSTEM

FIELD OF THE INVENTION

The present invention is directed to a cooking vessel support system, and a cooking appliance having a cooking vessel support system, in which the cooking vessel support system is easily removable and includes a gas burner and gas delivery system in which the gas burner is supported by a cooking vessel support above and spaced apart from the cooktop floor.

BACKGROUND OF THE INVENTION

Some modern gas surface cooking units, such as a gas range, stove, or cooktop, have one or more gas burners for heating foodstuff in a cooking vessel, such as a pot, pan, kettle, etc., and commonly include a cooking vessel support, such as a cooking grate, griddle, etc., positioned over one or more burners for supporting the cooking vessel over a burner. Some cooking ranges or cooktops include a cooktop floor (e.g., a spill tray, top sheet, top panel, cooktop surface, etc.) for catching spills, overflows, etc. from the cooking vessel and for concealing other components of the cooking unit, such as gas supply lines, electronics, internal cooling air systems, flue exhaust systems, etc. The one or more gas burners commonly are disposed on the cooktop floor, on a volcano-style pedestal formed on or with the cooktop floor, or on a separate pedestal on the cooktop floor, and supplied with an air-gas mixture from below the cooktop floor.

SUMMARY OF THE INVENTION

The present invention recognizes that, when a gas burner is disposed on the cooktop floor, on a volcano-style pedestal formed on or with the cooktop floor, or on a pedestal on the cooktop floor, the areas around the gas burner or the pedestal provide places where debris from foodstuff, spilled fluids and solids, overflows, etc. undesirably may catch, trap, or accumulate, thereby making it more difficult for a user to clean the cooktop around the gas burner or the gas burner itself. This is particularly the case at the intersection of the perimeter of the gas burner and the cooktop floor, the intersection of the pedestal and the cooktop floor, or the intersection of the pedestal and the gas burner. In many appliances, a cooking vessel support may be removable to facilitate easier cleaning of the cooktop floor, cleaning of the cooking vessel support, or cleaning/maintenance/repairs of components of the gas burners, igniters, etc. However, even when the cooking vessel support is removable, the areas around the gas burner or the pedestal may be difficult and time consuming for a user to clean. Furthermore, the gas burner of a conventional home cooking appliance may be close enough to the cooktop floor such that a flame of the gas burner may heat or bake debris onto the cooktop floor, thereby rendering cleaning of the cooktop more difficult and time consuming. Also, in many conventional appliances, a flame from the gas burner may be close enough to the surface of the cooktop floor to cause discoloration of the surface of the cooktop floor, for example, over a period of time and use. The discoloration of the surface may result in an undesirable appearance to a user. Moreover, the proximity of the gas burner to the cooktop floor may restrict or choke the availability of secondary air to the gas burner from above the cooktop floor, which may affect flame production or performance of the burner.

To solve these and other problems, the present invention provides a cooking appliance including a cooktop floor and a removable cooking vessel support system on the cooktop floor. The cooking vessel support system includes a support frame configured to support a cooking vessel above a gas burner, the support frame having at least a first arm supporting the gas burner above and spaced apart from the cooktop floor. The support frame includes an internal passageway in fluid communication with the gas burner and configured to draw primary air into the support frame at a location above the cooktop floor and to mix the primary air with an injected gas to provide an air-gas mixture. At least a portion of the internal passageway is formed in the first arm of the support frame such that the air-gas mixture is guided by the internal passageway through the first arm to the gas burner. In this way, the present invention can provide an easily removable cooking vessel support system having a gas burner integrally supported by the cooking vessel support frame above and apart from the cooktop floor, and being capable of discretely delivering gas to the gas burner through the cooking vessel support frame, thereby increasing cleanability of the cooktop floor and other components of the appliance while also providing an appearance or effect of a floating gas burner above the cooktop floor.

The present invention further recognizes that many cooktop burners are configured to draw primary air from within the housing of the appliance at or from a location or point below the cooktop floor. Such conventional cooktop burners typically mix the primary air with the gas at the location or point below the cooktop floor using, for example, a venturi tube disposed under the cooktop floor before guiding the air-gas mixture from below the cooktop floor through the cooktop to a burner mounted on top of the cooktop. The present invention recognizes that internal blowers/fans and airflow, such as cooling air blowers/fans, flue exhaust blowers/fans, cooling airflow paths, etc. within the appliance (e.g., under the cooktop floor) may cause undesirable disruptions or interference with the primary air being mixed with the gas at the point below the cooktop floor.

To solve these and other problems, the present invention further provides a "top breathing" cooking vessel support system that draws both primary and secondary air from or at a location above the cooktop floor. An example embodiment of the present invention provides a cooking vessel support system configured to receive gas from a gas supply at an injection point at the support frame and to draw primary air into the support frame at a location above the cooktop floor and to mix the primary air with the injected gas within a passageway of the support frame. In this way, the cooking vessel support system can be configured with a "top-breathing" gas burner in which the system draws both primary air and secondary air at locations above the cooktop floor, rather than drawing the primary air from a space below the cooktop floor and mixing the primary air and gas below the cooktop floor, thereby avoiding undesirable affects associated with disruption of, or interference with, the primary air caused by internal blowers/fans or other airflow below the cooktop floor of the appliance.

Additionally, the present invention recognizes that providing a cooking vessel support system that draws both primary and secondary air from above the cooktop floor presents additional challenges over conventional systems that draw primary air from the space below the cooktop floor. For example, by drawing both primary and secondary air from a location above the cooktop floor, the present invention recognizes that the system will need to share the available air in the space above the cooktop floor. That is, the cooking vessel support system will need to draw both primary and secondary air from generally the same area above the cooktop floor, which may result in too little or too much primary air being drawn into the system and mixed with the gas, and/or too little secondary air being available for combustion and flame production. Such imbalances of primary and secondary air may result, for example, in lazy or blurry flame kernels (e.g., the flame kernel laying down), which may cause the flame to be closer to the cooktop floor and possibly cause discoloration of the cooktop floor. Such imbalances of primary and secondary air also may result, for example, in lifting of flame kernels that are so-called reaching for secondary air, flame out of kernels, etc. Such imbalances of primary and secondary air may not only affect performance of the gas burner, but also may be perceived as visually undesirable to the user.

To solve these and other problems, the present invention further provides a cooking vessel support system having an injection point/location at or near a base of a leg of the support frame and configured both to receive gas injected from a gas supply and to draw primary air at a location above the cooktop floor into an interior passageway, thereby providing sufficient separation between the injection point/location of drawn primary air and the burner ports of the burner to minimize or avoid disruption or starving of secondary air around the gas burner that may be needed for adequate combustion of the air-gas mixture exiting the ports of the gas burner and for providing proper formation of flame kernels at the gas burner.

The present invention further provides a removable cooking vessel support system for a cooktop floor of a cooking appliance, the cooking vessel support system comprising a gas burner, and a support frame including a base having a lower surface for supporting the cooking vessel support system on the cooktop floor and a plurality of upper support surfaces configured to support a cooking vessel above the gas burner, wherein the support frame includes at least a first arm supporting the gas burner at a level between the lower surface of the base and the plurality of upper support surfaces such that the gas burner is configured to be supported by the support frame above and spaced apart from the cooktop floor, wherein the support frame includes an internal passageway in fluid communication with the gas burner and configured to draw primary air into the support frame at a location above the lower surface of the base and to mix the primary air with an injected gas to provide an air-gas mixture, at least a portion of the internal passageway being formed in the first arm of the support frame such that the air-gas mixture is guided by the internal passageway through the first arm to the gas burner.

The location above the cooktop floor at which the primary air is drawn into the support frame can be at a base of the support frame, such as a leg, that supports the cooking vessel support system on the cooktop floor, and more particularly, at a perimeter of the support frame that is spaced a predetermined distance apart from the gas burner. The internal passageway can include a mixing chamber configured to mix the primary air with the injected gas to provide the air-gas mixture. The mixing chamber can include a mixing surface within the support frame at the location above the cooktop floor that is in a flow path of the injected gas, a venturi within the support frame at a location above the cooktop floor, or the like. The mixing chamber (e.g., mixing surface, venturi, etc.) can be integrally formed with the internal passageway of the support frame or formed by a separate component disposed within the internal passageway of the support frame.

The features of the exemplary embodiments of the invention are important for, among other things, providing an easily removable cooking vessel support system for a cooking appliance having a gas burner integrally supported by the cooking vessel support above and apart from the cooktop floor, and which can discretely deliver gas to the gas burner through the cooking vessel support, thereby increasing cleanability of the cooktop floor and other components of the appliance while also providing an appearance of a floating gas burner above the cooktop floor. The features of the exemplary embodiments also can provide a cooking vessel support system that can be configured with a "top-breathing" gas burner, thereby avoiding undesirable affects associated with disruption of, or interference with, the primary air caused by internal blowers/fans or other airflow below the cooktop floor of the appliance, while at the same time providing sufficient separation between the injection point/location of drawn primary air and the burner ports of the burner to minimize or avoid disruption or starving of secondary air around the gas burner that may be needed for adequate combustion of the air-gas mixture exiting the ports of the gas burner and for providing proper formation of flame kernels at the gas burner. The features of the exemplary embodiments also can elevate a burner body of the gas burner in a vertical direction above the cooktop floor, which may reduce or minimize the susceptibility of the appliance to trapping or capturing food or spills around the gas burner, while at the same time providing separation or clearance between the surface of the cooktop floor and the gas burner to minimize or prevent burning of spills (e.g., a liquid or solid) onto the surface of the cooktop floor, thereby improving the cleanability of the appliance. The features of the exemplary embodiments also can provide a cooking vessel support system that may improve air flow to the gas burner from below the gas burner, as well as from the sides of the gas burner, thereby improving flame production and increasing the performance of the gas burner.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

With reference to FIGS. 1-9, exemplary embodiments of a cooking vessel support system 200, and a cooking appliance 10 including a gas surface cooking unit 100 having a cooking vessel support system 200, will now be described.

Figure 1:
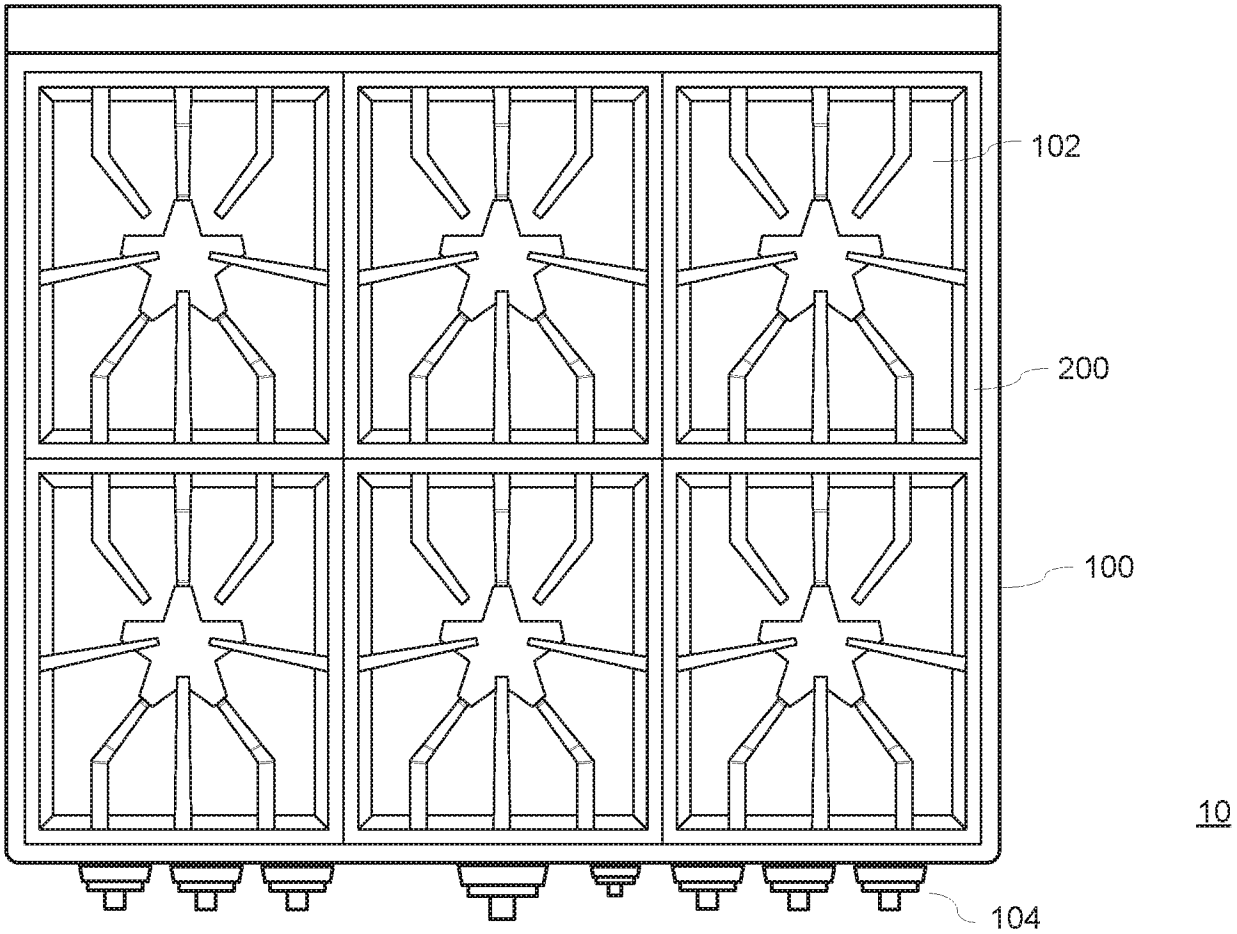
FIG. 1 is a top view of a cooking appliance having a cooking vessel support system according to an exemplary embodiment of the invention.

FIG. 1 illustrates an example of a cooking appliance 10 having a gas surface cooking unit 100 including one or more gas burners for heating foodstuff in a cooking vessel, such as a pot, pan, kettle, etc. The gas surface cooking unit 100 can be, for example, a surface cooking unit of a freestanding or slide-in gas range (e.g., a gas cooktop, gas or electric oven combination, dual-fuel range, etc.), a gas cooktop or rangetop (e.g., counter mounted, island mounted, etc.), a gas hob, a gas stove, a gas grill, a standalone gas burner cooker (e.g., a countertop cooker), etc. The gas surface cooking unit 100 can include a cooktop floor 102 (e.g., a fixed or removable spill tray or top sheet, glass surface, etc.) for catching spills, overflows, etc. from a cooking vessel and/or for concealing other components of the cooking unit, such as gas supply lines, electrical wiring, etc. (not visible in FIG. 1). The gas surface cooking unit 100 includes one or more cooking vessel support systems 200, such as a cooking grate, griddle, grill, teppanyaki grill, etc., for supporting one or more cooking vessels. As will be explained in greater detail with reference to FIGS. 2-9, the cooking vessel support system 200 can include a support frame that supports a gas burner (e.g., an integral gas burner) above and spaced apart from the cooktop floor 102, while at the same time discretely delivering gas to the gas burner through the cooking vessel support frame. The cooking vessel support system 200 can be removable from the gas surface cooking unit 100 (e.g., removable from the cooktop floor 102 for cleaning, repairs, maintenance, etc.), thereby increasing cleanability of the cooktop floor and other components of the appliance. In other examples, the cooking vessel support 200 can be moveable with respect to the gas surface cooking unit 100 (e.g., the cooktop floor 102), such as being hinged with respect to the cooktop floor 102 of the gas surface cooking unit 100, or arranged to be elevated from the cooktop floor 102 of the gas surface cooking unit 100, etc. The gas surface cooking unit 100 can include a control panel, such as one or more control knobs 104, for controlling one or more gas burners, or other cooking components (e.g., oven, warming drawer, etc.) of the appliance 10.

Figure 5:
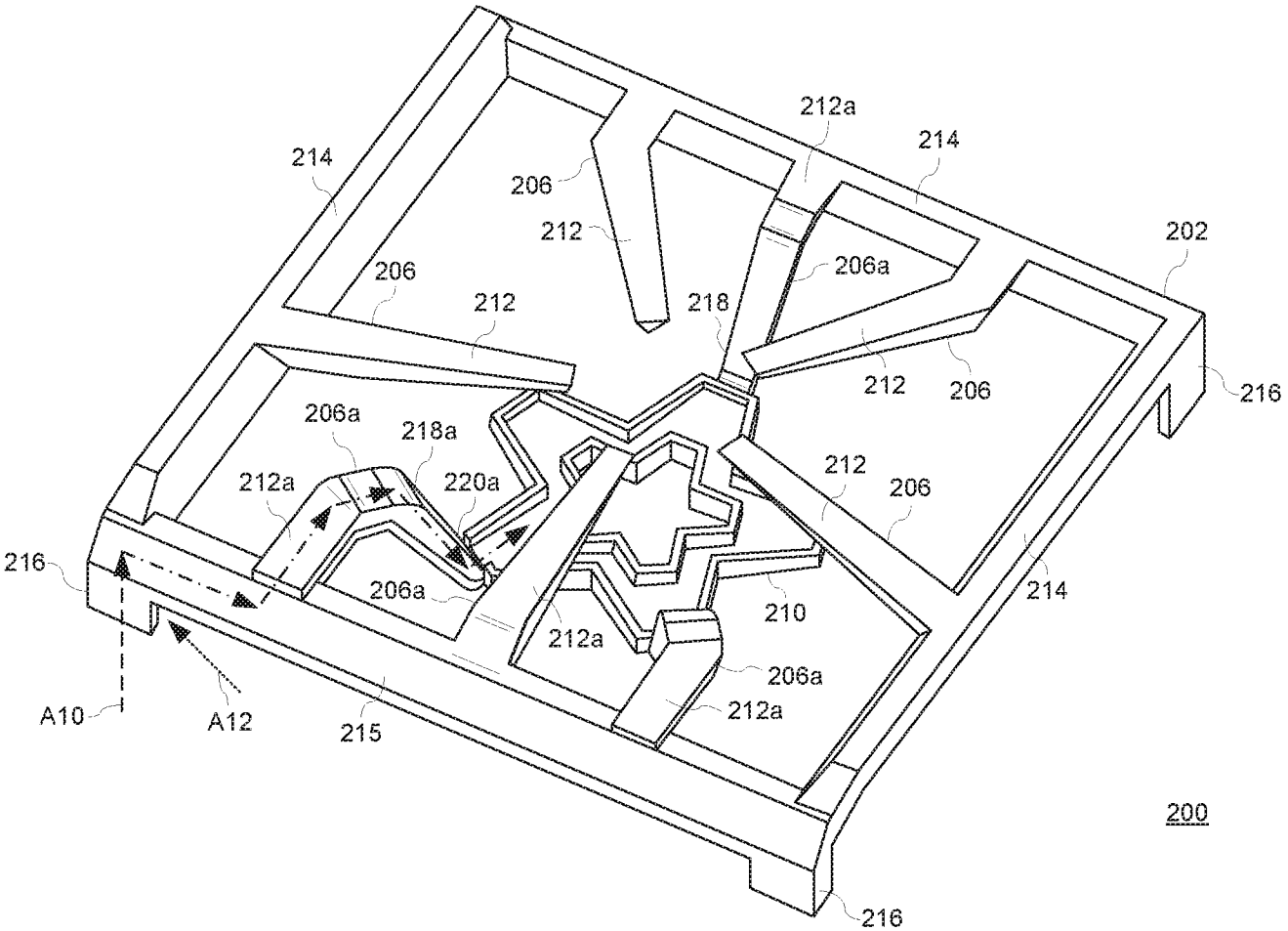
FIG. 5 is a perspective view of a cooking vessel support system according to an exemplary embodiment of the invention.
Figure 6:
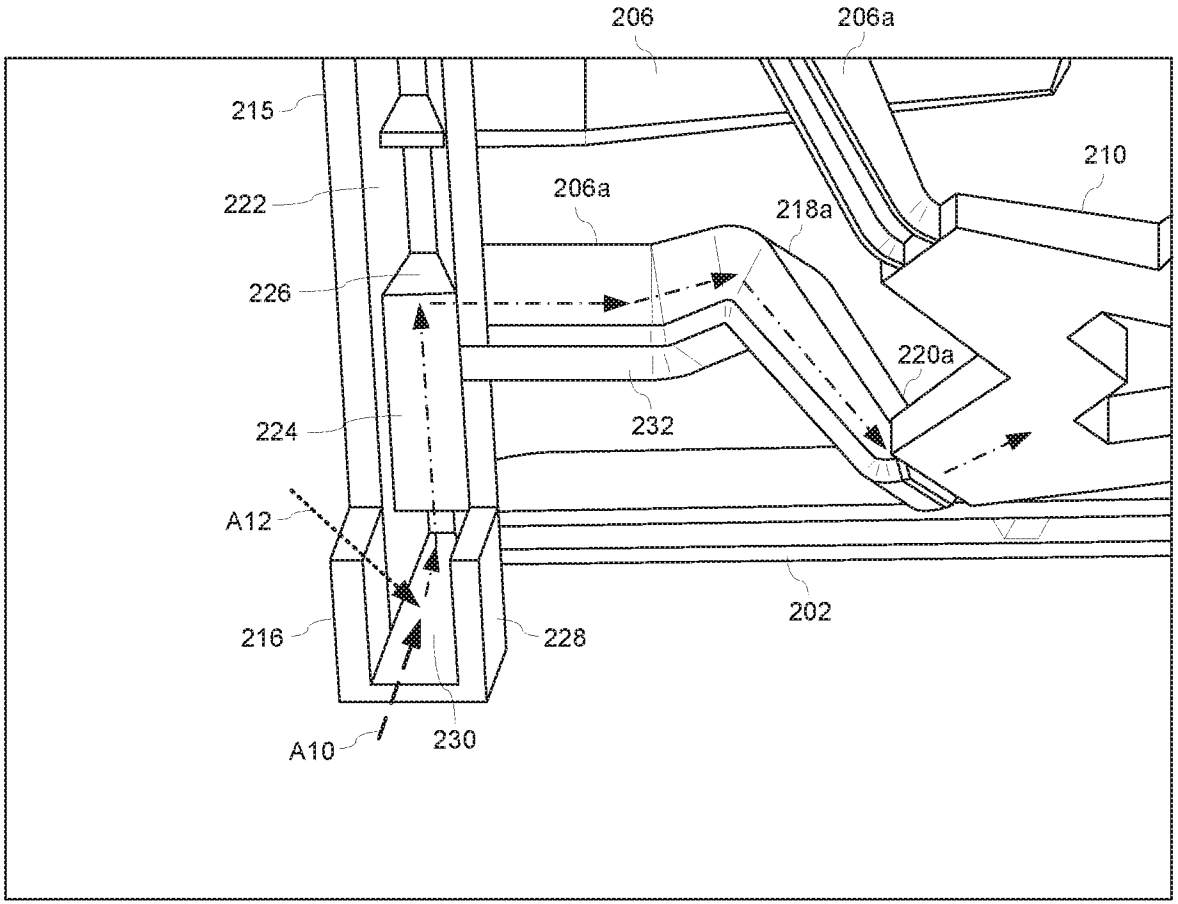
FIG. 6 is a partial lower perspective view of a cooking vessel support system according to an exemplary embodiment of the invention.
Figure 7:
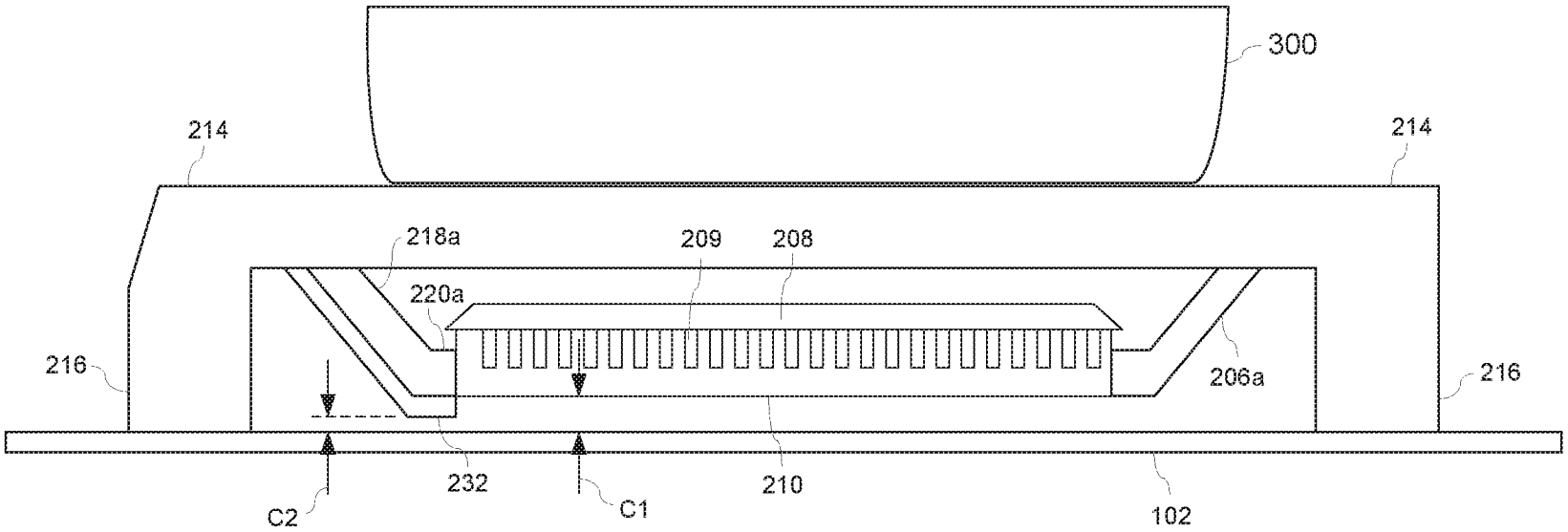
FIG. 7 is a schematic side view of a cooking vessel support system according to an exemplary embodiment of the invention.

FIGS. 2-9 illustrate several examples of a cooking vessel support system 200 for supporting a cooking vessel (see, e.g., 300 in FIG. 7). With reference to the example features in FIGS. 2 and 3, the cooking vessel support system 200 can include a cooking vessel support frame 202 (hereinafter, support frame), such as a cooking grate, for supporting a cooking vessel. The support frame 202 can include a plurality of arms 206, 206*a* for supporting a cooking vessel above a gas burner 204. For example, one or more of the arms 206, 206*a* can include an upper surface portion 212, 212*a* that is level with the upper surface portion of one or more other arms to provide a level support surface for supporting a cooking vessel over a gas burner 204. In some examples, the support frame 202 can include one or more upper surface portions 214 around all or a portion of the perimeter of the support frame 202 that are level with the upper surface portions 212 of the arms 206, 206*a* for providing a level support surface for the cooking vessel. As shown in the examples in FIGS. 5 and 9, the support frame 202 additionally or alternatively can include one or more upper surface portions 215 around all or a portion of the perimeter of the support frame 202 that are lower, or angled lower, than the upper surface portions 212, 212*a* of the arms 206, 206*a*. For example, the upper surface 215 of the front side of the support frame 202 can be lower, or angled lower, in order to facilitate easier placement of a cooking vessel 300 onto the support frame 202 by a user.

In the examples illustrated in FIGS. 2-9, one or more of the arms 206 can extend inward from the support frame 202 toward a space above the gas burner 204 and terminate at a free end above the gas burner 204. The arms 206, 206*a* can have various sizes, shapes, or arrangements, such as straight portions, curved portions, angled portions, or combinations thereof, and can extend across all, or a portion, of the width of the support frame 202. The support frame 202 can be configured to rest directly on an upper surface of the cooktop floor 102 or to be supported above the cooktop floor 102 on another component of the appliance, such as one or more sidewalls adjacent to or above the cooktop floor 102. One or more portions of the support frame 202 can be configured to contact (e.g., directly contact) an upper surface of the cooktop floor 102 or another component of the appliance 10. For example, as shown in FIGS. 5-9, a support frame 202 can include a leg or base portion 216 at each corner for supporting the support frame 202 on the cooktop floor 102 while spacing other portions of the support frame 202 from the cooktop floor 102, thereby minimizing physical and thermal contact between the cooking vessel support frame 202 and the cooktop floor 102.

Figure 2:
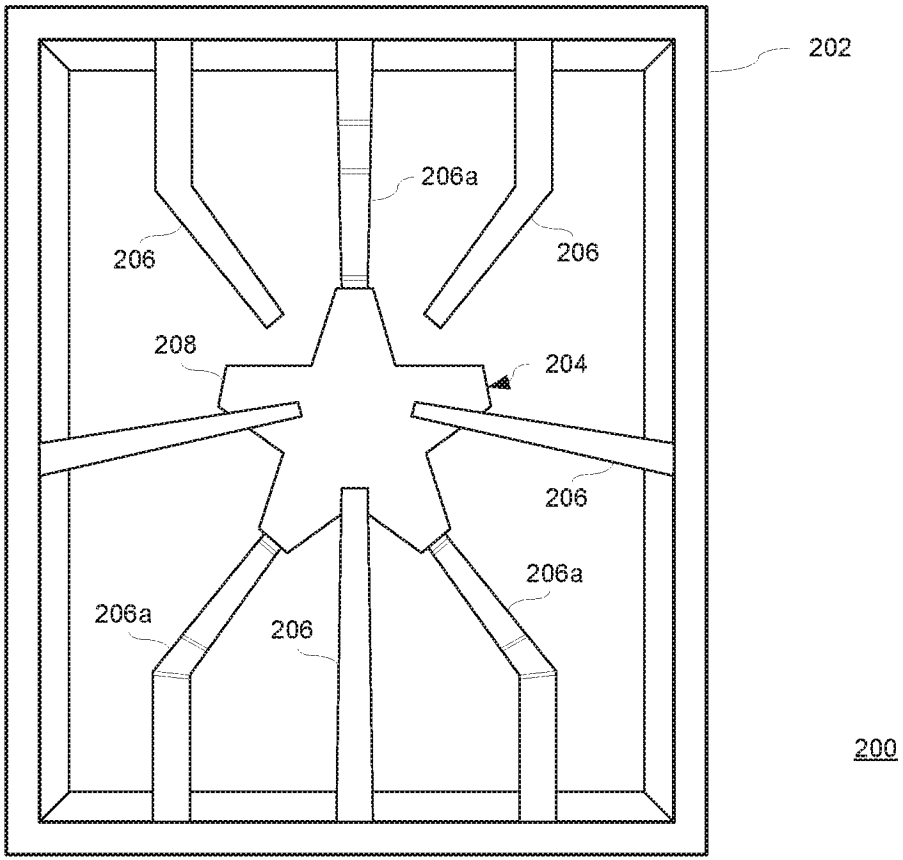
FIG. 2 is a top view of a cooking vessel support system according to an exemplary embodiment of the invention.
Figure 3:
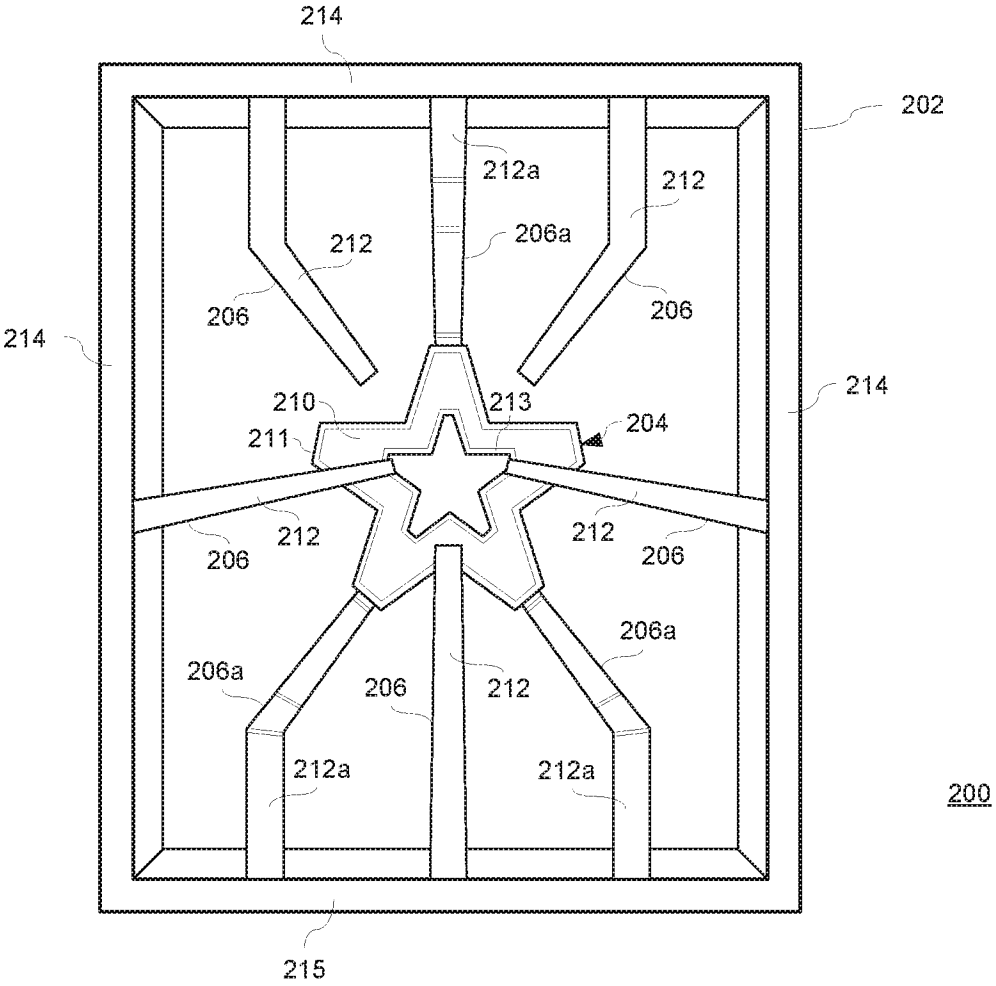
FIG. 3 is another top view of a cooking vessel support system according to an exemplary embodiment of the invention.
Figure 8:
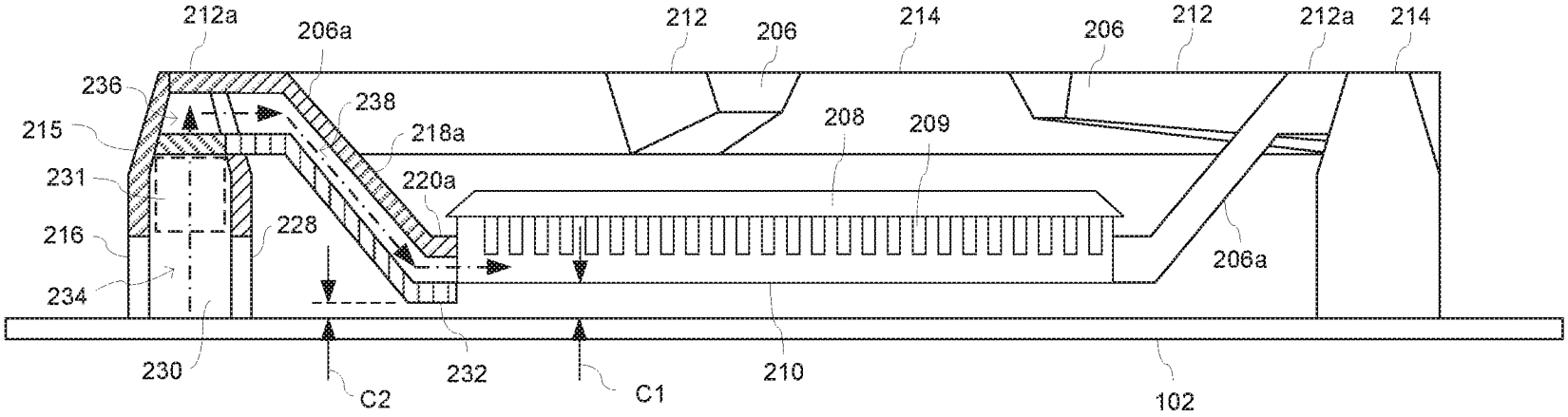
FIG. 8 is a schematic partial cross-sectional view of a cooking vessel support system according to an exemplary embodiment of the invention.

With reference again to FIGS. 2 and 3, the cooking vessel support system 200 can include a gas burner 204 integrally formed with, or coupled to and supported by, the support frame 202. The gas burner 204 can include, for example, a burner cap 208 and burner body 210 that cooperate to define an interior chamber or cavity configured to receive an air-gas mixture. The burner cap 208 can cover the burner body 210 to prevent leakage or overspills from cooking utensils from entering the burner body 210. FIG. 2 shows an example of a support system 200 with a gas burner 204 having a burner cap 208 in place, and FIG. 3 shows a gas burner 204 with a burner cap 208 removed from the burner body 210 for clarity. One of ordinary skill will understand that the burner body 210 can include a plurality of recesses forming flame ports such as flame ports 209, which are shown in FIGS. 7 and 8. For clarity, FIGS. 7 and 8 schematically illustrate a burner body 210, burner cap 208, and flame ports 209. It will be appreciated that the burner body 210 and burner cap 208 can have various shapes, arrangements, and/or configurations, such as a star configuration, round, square, etc., and the flame ports 209 formed on one or more parts of the burner body 210. The flame ports 209 can be arranged in fluid communication with one or more interior chambers or cavities of the burner body 210 and the exterior of the burner body 210 for permitting a flow of the air-gas mixture from the burner body 210 to exit the burner 204, where the air-gas mixture can be ignited by an igniter (not shown) to produce flame kernels. The gas burner 204 can be configured as a single burner, dual burner, or any number of burners. The burner body 210 can include a plurality of flame ports, for example, around one or more edge surfaces of the burner body 210. One of ordinary skill will understand that various configurations and arrangements of flame ports are possible, including various sizes, shapes, angles, numbers, spacings, etc. For example, the burner body 210 can include a plurality of flame ports extending around an outer perimeter edge 211 of the burner body 210, and/or the burner body 210 can include an opening, void, or slot, such as a central opening, that includes a plurality of flame ports extending around an inner perimeter edge 213 of the opening of the burner body 210. In the latter example, the burner cap 208 can have an opening corresponding to the inner perimeter edge 213.

Figure 4:
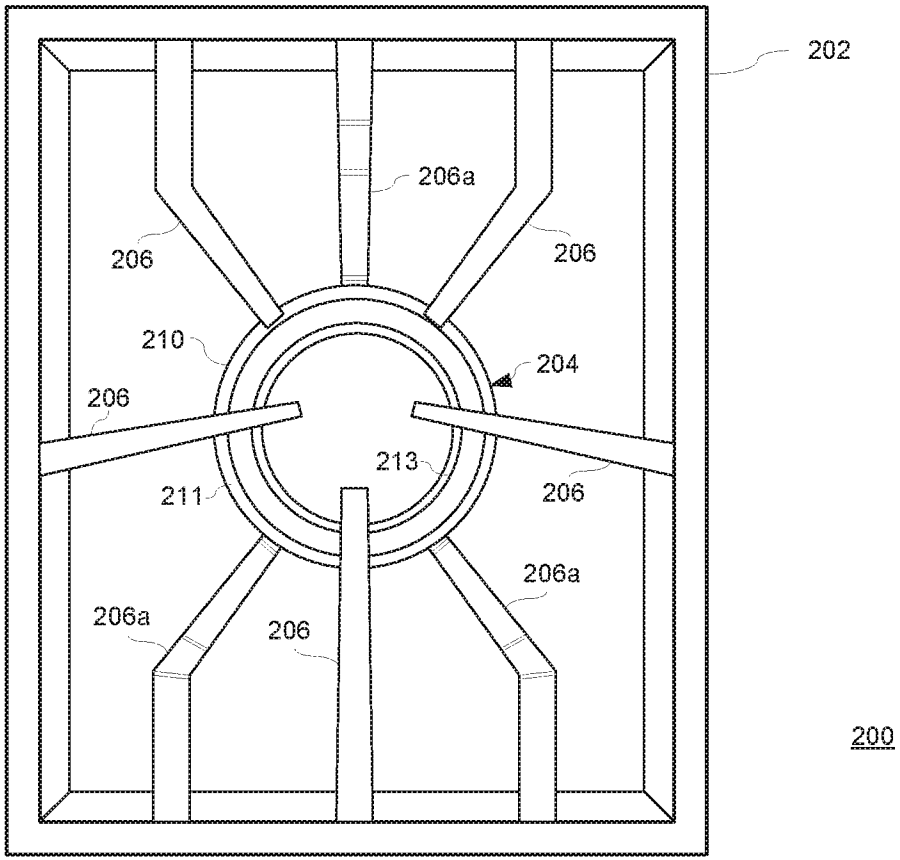
FIG. 4 is a top view of a cooking vessel support system according to an exemplary embodiment of the invention.

As shown in the examples illustrated in FIGS. 2 and 3, the burner body 210 can be configured to include a plurality of fingers that form a star configuration. The burner cap 208 can have a corresponding star configuration. In this example, the burner body 208 has five fingers that form a star configuration. One of ordinary skill in the art will recognize that other arrangements and configurations can be provided, such as a different number, shape, pattern, etc. of the fingers of the burner body 210 and burner cap 208 than shown in the example embodiments, or a different shape of the burner body 210 and burner cap 208 than shown in the example embodiments, such as a circular, oval, rectangular, square, triangular, other shape, an irregular shape, etc. For example, FIG. 4 illustrates an example of a cooking vessel support system 200 with a circular gas burner 202 having an outer circular ring 211 with flame ports and an inner circular ring 213 with flame ports. A size, shape, arrangement, etc. of the burner cap 208 can be configured to closely correspond to the size, shape, arrangement, etc. of the burner body 210, or the burner cap 208 may differ from the burner body 210 in one or more ways.

With reference again to FIGS. 2-9, the support frame 202 can be configured to support the gas burner body 210 in a position above and spaced apart from the cooktop floor 102. For example, one or more of the arms 206*a* of the support frame 202 can be configured to support the gas burner body 210. As shown in the illustrated examples, one or more of the arms 206*a* can include a first end coupled to or integrally formed with the support frame 202, such as a perimeter of the support frame 202. The first end of one or more of the arms 206*a* can include an upper surface portion 212*a* that is level with the upper surface portion 212 of the other arms 206 to provide a level support surface for supporting a cooking vessel over the gas burner 204. In this example, the first end of the arm 206*a* is coupled to a perimeter edge of the support frame 202 and on top of the support frame 202. In other examples, the first end of one or more arms 206*a* can be coupled to other parts of the support frame 202, such as an upper, lower, or side edge, an upper surface, a lower surface, a corner, etc. of the support frame 202. An intermediate part or parts also can be provided to couple one or more of the arms 206*a* to the support frame 202.

As shown, for example, in FIGS. 5-9, a portion 218*a* of an arm 206*a* can be angled or curved downward below the upper surface portions 212, 212*a* of the arms 206, 206*a*. A second end 220*a* of the arm 206*a* can be coupled to, or integrally formed with, a part of the burner body 210 of the gas burner 204. In this example, the second end 220*a* of the arm 206*a* is coupled to a perimeter side surface of the burner body 210, such as a perimeter side surface of a finger of a burner body 210 having a star configuration, a perimeter side surface of a burner body 210 having a circular configuration, etc. In other examples, the second end 220*a* of one or more arms 206*a* can be coupled to other parts of the burner body 210, such as an upper, lower, or side edge, an upper surface, a lower surface, a corner, etc. of the burner body 210. An intermediate part or parts also can be provided to couple the second end 220*a* to the burner body 210. One or more of the arms 206, 206*a* can be integrally formed with the support frame 202 or formed by separate components that are coupled to the support frame 202. The arms 206*a* can be formed from one or more components (e.g., formed by a single cast part or an assembly of parts). Similarly, one or more of the arms 206*a* can be integrally formed with the burner body 210, or separately formed components that are coupled to the burner body 210. The support frame 202, arms 206, 206*a*, and burner body 210 can be integrally formed, for example, by a single part (e.g., a single cast or machined part) or by an assembly of parts (e.g., an assembly of cast and/or machined parts). In the examples shown in FIGS. 2, 3, 5, and 9, the star-shaped burner body 210 is coupled to and supported by three arms 206*a*, which are coupled to perimeter outer side surface of three of the fingers, or points, of the burner body 210 having the star configuration. In other embodiments, the burner body 210 can be coupled to and supported by any number of arms 206*a*, such as a single arm, two arms, three arms, four arms, five arms, etc. In the example in FIG. 4, three arms 206*a* are coupled to the perimeter outer side surface of a circular burner body 210. In other embodiments, a burner body 210 having a different shape, such as a circular shape, square shape, etc., can be coupled to and supported by any number of arms 206*a*, such as a single arm, two arms, three arms, four arms, five arms, etc.

With reference again to the examples in FIGS. 5-9, one or more of the arms 206*a* can support the gas burner 204 in a position between the upper surface portions 212, 212*a* of the arms 206, 206*a* and the cooktop floor 102. In this way, an upper surface of the burner cap 208 is positioned below the upper surface portions 212, 212*a* of the arms 206, 206*a*, while a lower surface of the burner body 210 is positioned above and spaced apart from the cooktop floor 102 when the support system 200 is positioned on the cooktop floor 102, thereby providing the appearance of the gas burner 204 floating between the support frame 202 and the cooktop floor 102. As shown in FIGS. 7 and 8, the lower surface of the gas burner body 210 can be disposed at a higher position (e.g., in a different horizontal plane) than a lower surface of the base 216 of the support frame 202, which rests on the cooktop floor 102, thereby providing a vertical clearance C1(e.g., a predetermined vertical clearance) between the lower surface of the gas burner body 210 and the cooktop floor 102. The vertical clearance C1 may make it easier for a user to access and clean the surface of the cooktop floor 102 under the gas burner body 210, even when the support system 200 is mounted on the cooktop floor 102. The vertical clearance C1 also may provide sufficient separation or distance between the burner 204 and the cooktop floor 102 to minimize or prevent burning of spills (e.g., a liquid or solid) onto the cooktop floor 102, thereby further improving the cleanability of the appliance. The vertical clearance C1 also may improve a flow of secondary air to the burner 204 from around burner 204 (e.g., from below or from the sides of the burner 204), which may improve combustion and flame production and increase the performance of the burner 204.

In some examples, the arms 206, 206*a* can have a uniform arrangement such that the support surfaces 212, 212*a* provide a uniform support surface for supporting a cooking vessel (e.g., 300 in FIG. 7). As shown in FIGS. 2-4, the adjacent or opposing arms 206, 206*a* can be configured to have a corresponding or symmetric shape (e.g., a same or similar shape, a mirror-image shape, etc.) with respect to each other when viewed from above (i.e., plan view). In this way, although portions 218*a* of the arms 206*a* extend downward to the burner body 210 as compared to arms 206, the arms 206, 206*a* continue to have a uniform and/or symmetric arrangement when viewed from above, which may also contribute to the appearance of the gas burner 204 floating below the arms and support surfaces of the support frame 202.

With reference to FIGS. 5-9, the cooking vessel support system 200 can be configured to discretely convey an air-gas mixture to the gas burner 204 through one or more passageways formed in, or on, one or more parts of the support frame 202, while at the same time allowing the cooking vessel support system 200 (including the support frame 202 and the gas burner 204) to be easily removable from the cooktop floor 102. Additionally, the cooking vessel support system 200 can be configured to receive gas A10 from a gas supply at an injection point at the support frame 202, and to draw primary air A12 into the support frame 202 at a location above the cooktop floor 102 and mix the primary air A12 with the injected gas A10 within a passageway of the support frame 202. In some examples, the support frame 202 can include one or more injection points above the cooktop floor 102 that are configured to receive gas from a gas supply and primary air A12 into an interior passageway (e.g., 234, 236, and/or 238 in FIG. 8) formed in the support frame 202. The interior passageway (e.g., 234, 236, and/or 238 in FIG. 8) can extend from the injection point through one or more arms 206*a* of the support frame 202 and into the burner body 210 to discretely convey an air-gas mixture from the injection point to a chamber of the gas burner 204.

FIGS. 5, 6, and 8 illustrate an example of a support frame 202 having an injection point at or near a base of a leg 216 of the support frame 202 and configured to receive gas A10 from a gas supply into a first portion (e.g., 234) of an interior passageway formed in the leg 216. In this example, the first portion (e.g., 234) of an interior passageway extends from the injection point through at least a portion of the leg 216 and into a frame section 215 of the support frame 202. Next, a second portion (e.g., 236) of the interior passageway extends through at least a portion of the frame section 215 of the support frame 202 and into an arm 206*a*. A third portion (e.g., 238) of the interior passageway extends through at least a portion of the arm 206*a* (e.g., through sections 212*a*, 218*a*, 220*a* of arm 206*a*) to an opening, slot, etc. in the burner body 210, which is in fluid communication with a cavity within the burner body 210. In this way, the passageway (e.g., 234, 236, and/or 238) fluidly connects the injection point with the cavity/chamber of the burner body 210.

The interior passageway (e.g., 234, 236, and/or 238) can be formed in the support frame 202 in a number of suitable ways. For example, the interior passageway can be formed by one or more hollow cavities, conduits, tubes, etc. that are cast into one or more parts of the support frame 202 (e.g., leg 216, frame section 215, and/or arm 206*a*). In other examples, one or more parts of the support frame 202 (e.g., leg 216, frame section 215, and/or arm 206*a*) can include one or more channels, slots, grooves, etc. formed (e.g., cast, machined, etc.) in the support frame 202, which can be covered, for example, by one or more cover plates to form a hallow passageway. In still other examples, the passageway can be formed by a combination of enclosed cast parts and channels with covers, etc. The interior passageway can be formed in one or more inward or downward facing surfaces of the support frame 202, such as an inward facing side of a leg 216, a downward facing side of a portion of a perimeter of the support frame 202, a downward facing side of one or more of the arms 206*a*, etc., such that the one or more cover plates (e.g. 224, 226, 232 in FIG. 6) may be concealed, or at least not prominently visible, to a user of the appliance when the support frame 202 is disposed on the cooktop floor 102.

For example, with reference to the example shown in FIGS. 6 and 8, a first portion 234 of an interior passageway can be formed by one or more walls forming the leg 216. The first portion 234 of the interior passageway can be further defined, for example, by surface 230 and/or wall 228. In this example, the frame section 215 is hallow or has a channel 222 extending lengthwise therein. A second portion 236 of the interior passageway can be formed by one or more walls or plates 224, 226 cooperating with one or more interior walls of the channel 222 of the frame section 215 to form a passageway. The second portion 236 of the interior passageway can be fluidly connected on one end to the first portion 234. The second portion 236 of the interior passageway can be fluidly connected on another end to the third portion 238 of the passageway within the arm 206*a*, for example, by an opening, slot, void, etc. in a portion of the frame section 215 facing the arm 206*a*. In the example of FIGS. 6-8, the arm 206*a* is hallow or has a channel extending lengthwise therein. The third portion 238 of the interior passageway can be formed by one or more walls or plates 232 cooperating with the interior walls of the arm 206*a* to form a passageway. In this example, the plate 232 is coupled to an underside of the arm 206*a* to cover a channel in the arm 206*a* and form the third portion 238 of the passageway.

With reference to FIGS. 7 and 8, the lower surface of the plate 238 can be disposed at a higher position (i.e., in a different plane) than a lower surface of the base 216 of the support frame 202, which rests on the cooktop floor 102, thereby providing a vertical clearance C2 (e.g., a predetermined vertical clearance) between the lower surface of the plate 232 and the cooktop floor 102. The vertical clearance C2 can be the same as or different from vertical clearance C1. For example, the plate 232 can be recessed within the arm 206*a* such that all or a portion of the plate 232 is flush with other surfaces of the arm 206*a* or flush with an adjacent surface of the burner body 210 such that the clearance C2 is equal to or greater than the clearance C1.

In accordance with the example embodiments, the passageway (e.g., 234, 236, and/or 238) can be configured to fluidly connect the injection point with the cavity of the burner body 210 and the cooking vessel support system 200 can discretely convey an air-gas mixture to the gas burner 204, while at the same time allowing the cooking vessel support system 200 (including the support frame 202 and the gas burner 204) to be easily removable from the cooktop floor 102.

In the example illustrated in FIGS. 5-8, the support system 200 has a burner body 210 supplied with an air-gas mixture through a single arm 206*a*. However, in other examples, the support system 200 can supply the air-gas mixture to the burner body 210 through more than one arm

Figure 9:
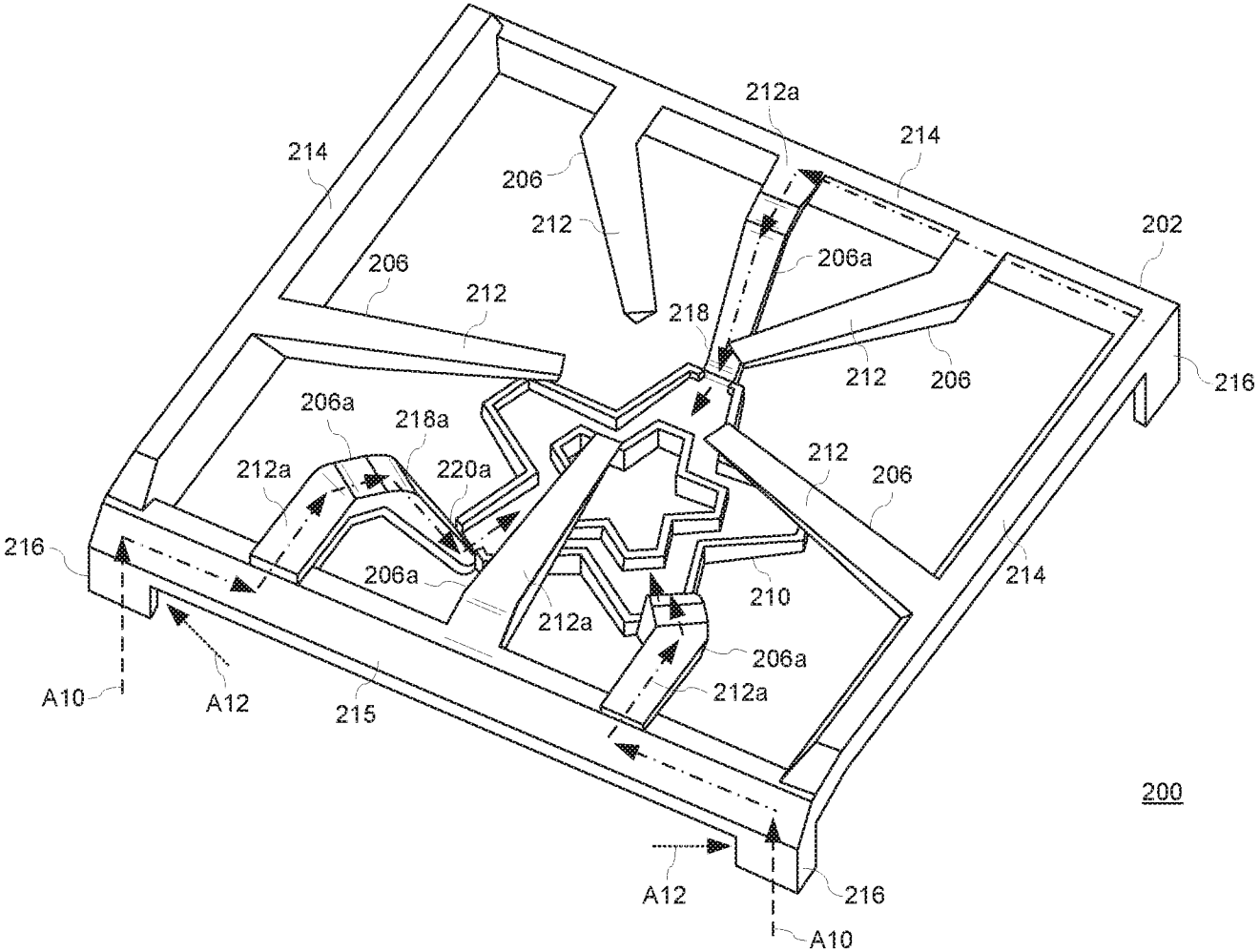
FIG. 9 is a cooking vessel support system according to an exemplary embodiment of the invention.

206*a* (e.g., two arms, three arms, four arms, five arms, etc.). For example, FIG. 9 illustrates an example of a support system 200 having a burner body 210 supplied with an air-gas mixture through three arms 206*a*. In other examples, the passageway (e.g., 234, 236, and/or 238) can extend through one or more other parts of the support frame 202. For example, the passageway can extend through a leg of the support frame and directly into an arm.

As mentioned, the cooking vessel support system 200 can be configured to receive gas A10 from a gas supply at an injection point at the support frame 202. The cooking vessel support system 200 also can be configured to draw primary air A12 into the support frame 202 at a location above the cooktop floor 102 and mix the primary air A12 with the injected gas A10 within a passageway of the support frame 202. In this way, the cooking vessel support system 200 can be configured as a "top-breathing" burner assembly in which the burner draws both primary air A10 and secondary air A12 from above the cooktop floor 102, rather than mixing primary air with the gas below the cooktop floor 102. As a result, the cooking vessel support system 200 can avoid undesirable affects associated with drawing primary air from below the cooktop floor 102, such as disruption of, or interference with, the primary air below the cooktop floor 102 caused by internal blowers/fans and airflow, such as cooling air blowers/fans, flue exhaust blowers/fans, etc., below the cooktop floor 102 of the appliance 10.

As shown in FIGS. 6-8, the support frame 202 can include one or more injection points above the cooktop floor 102 and configured to receive gas from a gas supply and primary air A12 into the interior passageway (e.g., 234) formed in the support frame 202. In this example, the injection point can be provided at or near a base of a leg 216 of the support frame 202 and configured to both receive gas A10 injected from a gas supply and to draw primary air A12 from above the cooktop floor 102 into a first portion 234 of an interior passageway formed in the leg 216. The leg 216 can be configured to include a mixing chamber having, for example, a mixing surface 230, or another component such as a venturi, tunnel, etc. (e.g., 231 shown by dashed lines) for mixing the gas A10 with the primary air A12. For example, as shown in FIGS. 6 and 8, the support frame 202, such as the leg 216 of the support frame 202, can be configured as a venturi to draw in primary air A12 from above the cooktop floor 102 into the passageway 234 within the support frame 102. The base of the leg 216 can have one or more open sides and/or one or more openings, apertures, slots, etc. on one or more sides to permit primary air A12 to be drawn from above the cooktop floor 102 into the passageway 234 of the support frame 202 by the negative pressure resulting from a flow of the gas A10 being injected into the mixing chamber or another component. In examples, a mixing surface 230 can be integrally formed with the support frame 202 or formed by one or more separate components that can be coupled to, or inserted into, the first portion 234 of an interior passageway of the support frame 202, or into another portion (e.g., 236, etc.) of the interior passageway. In another example, a venturi 231 can be integrally formed with the support frame 202 or formed by one or more separate components that can be coupled to, or inserted into, the first portion 234 of an interior passageway of the support frame 202, or into another portion (e.g., 236, etc.) of the interior passageway. By locating the injection point at or near a base of a leg 216 at a perimeter of the support frame 202 and drawing primary air A12 from above the cooktop floor 102 at or near the base of the leg 216, the cooking vessel support system 200 can provide sufficient separation (e.g., a predetermined distance or spacing) between the injection point/location of drawn primary air A12 and the burner ports of the burner 204, which may minimize or avoid disruption of secondary air (e.g., minimize or avoid starving the burner of secondary air) that may be needed for adequate combustion of the air-gas mixture exiting the ports of the gas burner 204 or for proper formation of flame kernels at the gas burner 204.

One of ordinary skill in the art will recognize that other arrangements and configurations are possible within the spirit and scope of the examples illustrated.

With reference again to FIGS. 1-9, an exemplary embodiment of the invention includes a cooking appliance (e.g., 100) comprising a cooktop floor (e.g., 102); a cooking vessel support system (e.g., 200) on the cooktop floor (e.g., 102), the cooking vessel support system (e.g., 200) being removable from the cooktop floor (e.g., 102) and including a support frame (e.g., 202) configured to support a cooking vessel (e.g., 300) above a gas burner (e.g., 204), the support frame (e.g., 202) having at least a first arm (e.g., 206*a*) supporting the gas burner (e.g., 204) above and spaced apart from the cooktop floor (e.g., 102), wherein the support frame (e.g., 202) includes an internal passageway (e.g., 234, 236, and/or 238) in fluid communication with the gas burner (e.g., 204) and configured to draw primary air (e.g., A12) into the support frame (e.g., 202) at a location above the cooktop floor (e.g., 102) and to mix the primary air (e.g., A12) with an injected gas (e.g., A10) to provide an air-gas mixture, at least a portion of the internal passageway (e.g., 234, 236, and/or 238) being formed in the first arm (e.g., 206*a*) of the support frame (e.g., 202) such that the air-gas mixture is guided by the internal passageway (e.g., 234, 236, and/or 238) through the first arm (e.g., 206*a*) to the gas burner (e.g., 204).

Another exemplary embodiment of the invention includes a removable cooking vessel support system (e.g., 200) for a cooktop floor (e.g., 102) of a cooking appliance (e.g., 100), the cooking vessel support system (e.g., 200) comprising a gas burner (e.g., 204); and a support frame (e.g., 202) including a base (e.g., 216) having a lower surface for supporting the cooking vessel support system (e.g., 200) on the cooktop floor (e.g., 102) and a plurality of upper support surfaces (e.g., 212, 212*a*) configured to support a cooking vessel (e.g., 300) above the gas burner (e.g., 204), wherein the support frame (e.g., 202) includes at least a first arm (e.g., 206*a*) supporting the gas burner (e.g., 204) at a level between the lower surface of the base (e.g., 216) and the plurality of upper support surfaces (e.g., 212, 212*a*) such that the gas burner (e.g., 204) is configured to be supported by the support frame (e.g., 202) above and spaced apart from the cooktop floor (e.g., 102), wherein the support frame (e.g., 202) includes an internal passageway (e.g., 234, 236, and/or 238) in fluid communication with the gas burner (e.g., 204) and configured to draw primary air (e.g., A12) into the support frame (e.g., 202) at a location above the lower surface of the base (e.g., 216) and to mix the primary air (e.g., A12) with an injected gas (e.g., A10) to provide an air-gas mixture, at least a portion of the internal passageway (e.g., 234, 236, and/or 238) being formed in the first arm (e.g., 206*a*) of the support frame (e.g., 202) such that the air-gas mixture is guided by the internal passageway (e.g., 234, 236, and/or 238) through the first arm (e.g., 206*a*) to the gas burner (e.g., 204).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A cooking appliance comprising:

a cooktop floor; and a cooking vessel support system on the cooktop floor, the cooking vessel support system being removable from the cooktop floor and including a support frame configured to support a cooking vessel above a gas burner, the support frame having at least a first arm supporting the gas burner above and spaced apart from the cooktop floor, wherein the support frame includes an internal passageway in fluid communication with the gas burner and configured to draw primary air into the support frame at a location above the cooktop floor and to mix the primary air with an injected gas to provide an air-gas mixture, at least a portion of the internal passageway being formed in the first arm of the support frame such that the air-gas mixture is guided by the internal passageway through the first arm to the gas burner.

2. The cooking appliance of claim 1, wherein the location above the cooktop floor at which the primary air is drawn into the support frame is at a base of the support frame that supports the cooking vessel support system on the cooktop floor, the internal passageway being formed in the base and the first arm of the support frame such that the air-gas mixture is guided by the internal passageway from the base through the first arm to the gas burner.

3. The cooking appliance of claim 2, wherein the base is located at a perimeter of the support frame and spaced a predetermined distance apart from the gas burner.

4. The cooking appliance of claim 1, wherein the support frame includes a leg at a perimeter corner of the cooking vessel support system and spaced a predetermined distance apart from the gas burner, the leg supporting the cooking vessel support system on the cooktop floor, and wherein the location above the cooktop floor at which the primary air is drawn into the support frame is at the leg, the internal passageway being formed in the leg and the first arm of the support frame such that the air-gas mixture is guided by the internal passageway from the leg through the first arm to the gas burner.

5. The cooking appliance of claim 4, wherein an additional portion of the support frame between the leg and the first arm includes another portion of the internal passageway such that the air-gas mixture is guided by the internal passageway from the leg through the additional portion of the support frame to the first arm, and then through the first arm to the gas burner.

6. The cooking appliance of claim 1, wherein the internal passageway includes a mixing chamber at the location above the cooktop floor, the mixing chamber being configured to mix the primary air with the injected gas to provide the air-gas mixture.

7. The cooking appliance of claim 6, wherein the mixing chamber includes a mixing surface within the support frame at the location above the cooktop floor, the mixing surface being in a flow path of the injected gas.

8. The cooking appliance of claim 6, wherein the mixing chamber includes a venturi within the support frame at the location above the cooktop floor.

9. The cooking appliance of claim 8, wherein the venturi is integrally formed with the internal passageway of the support frame.

10. The cooking appliance of claim 6, wherein the mixing chamber is a separate component disposed within the internal passageway of the support frame.

11. The cooking appliance of claim 6, wherein the support frame includes an opening above the cooktop floor in fluid communication with the mixing chamber for drawing the primary air into the mixing chamber.

12. The cooking appliance of claim 1, wherein the support frame has a second arm supporting the gas burner above and spaced apart from the cooktop floor, and wherein the support frame includes a second mixing chamber configured to draw additional primary air into the support frame at a second location above the cooktop floor and to mix the additional primary air with additional injected gas to provide a second air-gas mixture, the support frame including a second internal passageway in fluid communication with the second mixing chamber and the gas burner, at least a portion of the second internal passageway being formed in the second arm of the support frame such that the second air-gas mixture is guided from the second mixing chamber through the second arm to the gas burner.

13. The cooking appliance of claim 12, wherein the gas burner includes a single chamber for receiving the air-gas mixture, and wherein the first internal passageway and the second internal passageway guide the first and second air-gas mixture, respectively, to the single chamber of the gas burner.

14. The cooking appliance of claim 12, wherein the gas burner includes a first chamber for receiving the air-gas mixture, and a second chamber for receiving the second air-gas mixture, and wherein the first internal passageway guides the first air-gas mixture to the first chamber of the gas burner, and wherein the second internal passageway guides the second air-gas mixture to the second chamber of the gas burner.

15. The cooking appliance of claim 12, wherein the support frame has a third arm supporting the gas burner above and spaced apart from the cooktop floor, and wherein the support frame includes a third mixing chamber configured to draw additional primary air into the support frame at a third location above the cooktop floor and to mix the additional primary air with additional injected gas to provide a third air-gas mixture, the support frame including a third internal passageway in fluid communication with the third mixing chamber and the gas burner, at least a portion of the third internal passageway being formed in the third arm of the support frame such that the third air-gas mixture is guided from the third mixing chamber through the third arm to the gas burner.

16. The cooking appliance of claim 1, wherein the support frame has a plurality of arms supporting the gas burner above and spaced apart from the cooktop floor.

17. The cooking appliance of claim 1, wherein the first arm has a first end coupled to the support frame and a second end coupled to the gas burner.

18. The cooking appliance of claim 17, wherein a portion of the first arm extends downward between the first end and the second end such that the gas burner is disposed below the first end while being above and spaced apart from the cooktop floor.

19. The cooking appliance of claim 17, wherein the first end is coupled to a side surface of a burner body of the gas burner.

20. The cooking appliance of claim 19, wherein the side surface of the burner body has an opening fluidly connecting the interior passageway in the first arm with a chamber of the burner body for receiving the air-gas mixture.

21. The cooking appliance of claim 1, wherein the support frame has a plurality of first arms supporting the gas burner above and spaced apart from the cooktop floor, and a plurality of second arms that do not support the gas burner, each of the plurality of first arms and the plurality of second arms having an upper support surface configured to support the cooking vessel above the gas burner, wherein the plurality of first arms and the plurality of second arms are symmetrically arranged on the support frame when viewed from above.

22. A removable cooking vessel support system for a cooktop floor of a cooking appliance, the cooking vessel support system comprising:

a gas burner; and a support frame including a base having a lower surface for supporting the cooking vessel support system on the cooktop floor and a plurality of upper support surfaces configured to support a cooking vessel above the gas burner, wherein the support frame includes at least a first arm supporting the gas burner at a level between the lower surface of the base and the plurality of upper support surfaces such that the gas burner is configured to be supported by the support frame above and spaced apart from the cooktop floor, and wherein the support frame includes an internal passageway in fluid communication with the gas burner and configured to draw primary air into the support frame at a location above the lower surface of the base and to mix the primary air with an injected gas to provide an air-gas mixture, at least a portion of the internal passageway being formed in the first arm of the support frame such that the air-gas mixture is guided by the internal passageway through the first arm to the gas burner.

* * * * *